US007283771B2

(12) United States Patent
Takahashi et al.

(10) Patent No.: US 7,283,771 B2
(45) Date of Patent: Oct. 16, 2007

(54) CHARGING ROLLER

(75) Inventors: Hirobumi Takahashi, Ushiku (JP); Tomoya Kawakami, Ushiku (JP); Ayumi Okuda, Moriya (JP); Hiroshi Abe, Ushiku (JP)

(73) Assignee: Canon Kasei Kabushiki Kaisha, Tsukuba (JP)

( * ) Notice: Subject to any disclaimer, the term of this patent is extended or adjusted under 35 U.S.C. 154(b) by 164 days.

(21) Appl. No.: 11/224,115

(22) Filed: Sep. 13, 2005

(65) Prior Publication Data

US 2006/0062597 A1 Mar. 23, 2006

(30) Foreign Application Priority Data

Sep. 17, 2004 (JP) ..... 2004-271809
Sep. 21, 2004 (JP) ..... 2004-273524

(51) Int. Cl.
*G03G 15/02* (2006.01)

(52) U.S. Cl. ..... 399/176; 361/221; 399/303; 399/313

(58) Field of Classification Search ..... 399/176, 399/174, 303, 313, 279, 286; 361/221, 214; 430/902; 492/18, 49, 53, 56
See application file for complete search history.

(56) References Cited

U.S. PATENT DOCUMENTS 4,967,231 A 10/1990 Hosoya et al. ..... 355/219
6,400,919 B1 * 6/2002 Inoue et al. ..... 399/176
6,559,210 B2 * 5/2003 Murata ..... 399/176 X
2002/0039500 A1 * 4/2002 Abe et al. ..... 399/176
2003/0161664 A1 * 8/2003 Abe et al. ..... 399/176
2003/0175045 A1 * 9/2003 Hara ..... 399/176
2004/0136753 A1 * 7/2004 Kato et al. ..... 399/176
2004/0197115 A1 10/2004 Abe et al. ..... 399/176
2006/0029428 A1 * 2/2006 Taniguchi et al. ..... 399/176

FOREIGN PATENT DOCUMENTS

JP 5-2313 1/1993
JP 5-96648 4/1993
JP 6-58325 3/1994

* cited by examiner

*Primary Examiner*—Sophia S. Chen
(74) *Attorney, Agent, or Firm*—Fitzpatrick, Cella, Harper & Scinto

(57) ABSTRACT

A contact charging roller includes a support member and a conductive coating member. The conductive coating member is composed of a seamless tube that contains at least (1) a non-polar resin or a styrene-type thermoplastic elastomer excluding a poly(styrene-hydrogentaged butadiene-styrene) block terpolymer and (2) a polar resin or an elastomer having a polar functional group containing at least nitrogen or oxygen, and contains carbon black in an amount of 10% to 60% by mass with respect to the total mass of the non-polar resin or elastomer and the polar resin or elastomer.

2 Claims, 2 Drawing Sheets

CHARGING ROLLER

BACKGROUND OF THE INVENTION

1. Field of the Invention

This invention relates to a charging roller, and more specifically to a charging roller used in a contact charging device that applies a voltage to a conductive member that is in contact with an electrophotographic photosensitive member to charge the electrophotographic photosensitive member surface to a predetermined electric potential.

2. Related Background Art

Although many methods have been proposed as an electrophotographic method, the generally used method has processes in which an electric latent image is formed on a photosensitive member through various means by using a photoconductive substance, and after the latent image have been developed by using toner to form a visible image and the toner image has been transferred onto a transfer medium such as paper on demand, the toner image is fixed on the transfer medium through heat, pressure or the like to obtain a copied object. Here, toner particles remaining on the photosensitive member without being transferred on the transfer medium is removed from the photosensitive member through a cleaning process.

Conventionally, the corona charger was used as a charging device for electrophotography. In recent years, instead of this, a contact charging device has been put into practical use. This device aims at low ozone and low power consumption, and among those devices of this type, in particular, a roller charging system in which a conductive roller is used as its charging member has been desirably used from the viewpoint of charging stability.

In the roller charging system, a conductive elastic roller is made in press-contact with a member to be charged so that a voltage is applied to this member; thus a charging process to the member to be charged is carried out.

More specifically, since the charging process is carried out by discharging to the member to be charged from the charging member, the charging process is started by applying a voltage that exceeds a certain threshold value. For example, when the charging roller is brought into pressure contact with an organic photosensitive member (OPC photosensitive member) having a photoconductive layer with a thickness of 25 μm, upon application of a voltage of about 640 V or more in terms of the absolute value, the surface electric potential starts to rise, and thereafter, the photosensitive member surface electric potential increases linearly with a gradient of 1 with respect to the applied voltage. Hereinafter, this threshold voltage value is defined as a charge starting voltage Vth.

In other words, in order to obtain the photosensitive member surface potential Vd required for electrophotography, the charging roller needs a DC voltage, Vd+Vth, that is more than a voltage required for the image forming process itself. This method which applies only the DC voltage to the contact charging member to carry out a charging process is referred to as DC charging.

However, in the DC charging, since the resistance value of a contact charging member tends to vary due to environmental variations and the like, or since Vth fluctuates when the thickness varies due to abrasion of the photosensitive member, with the result that it becomes difficult to set the electric potential of the photosensitive member to a desired value.

For this reason, in order to further attain uniformity in charging, an AC+DC charging system, which applies a voltage generated by superposing an AC component having a peak-to-peak voltage of more than 2×Vth on a DC voltage corresponding to desired Vd to the contact charging member, is used. This system, which aims at an equalizing effect of electric potential by the use of AC, converges the electric potential of the member to be charged to Vd that comes to be the center of the peak of the AC voltage so that the electric potential is hardly influenced by disturbances in the environment or the like.

With respect to the conductive member used for charging, for example, a member in which a surface layer is formed on a conductive support member by using a conductive seamless tube has been proposed (see the specification of U.S. Pat. No. 4,967,231). Moreover, a seamless tube made of fluororesin (see Japanese Patent Application Laid-Open No. H05-2313) and a multi-layer tube constituted by layers having different conductive properties (see Japanese Patent Application Laid-Open No. H05-96648) have been disclosed. With respect to the method for manufacturing the charging member, the above-mentioned conventional techniques include a method in which the charging member is formed by using an insertion process. Moreover, a surface formation method using a cross-head extruder has been proposed (see Japanese Patent Application Laid-Open No. H06-58325).

In such a method in which the charging roller is formed by using a seamless tube, even when a foaming material is used as an elastic body layer on a base member, the foaming material is further coated with the seamless tube so that a smooth face can be formed to provide a more uniform charging process.

With respect to the method for allowing the seamless tube to have a conductive property, in general, an ion-conduction method in which a salt is used as a conductive agent and an electron conduction method in which a material such as carbon black, a conductive metal oxide and metal powder is used as a conductive agent have been proposed. When the conductive property is imparted by ion conduction, problems are raised in that the resistance value tends to fluctuate greatly due to the environment and the salt tends to contaminate the photosensitive member since the salt comes into contact with the electrophotographic photosensitive member. Therefore, in the present invention, carbon black was used as the conductive agent.

However, when the seamless tube which uses a thermoplastic resin as the base material is produced, resistance changes due to the tube expansion and contraction caused by the size of the foaming layer forming the base layer upon coating the tube. Another problem is raised in that the tube is expanded or contracted and resistance changes due to the influence of the foaming layer forming the base layer involved in changes in the environment or a lapse of time.

SUMMARY OF THE INVENTION

Therefore, an objective of the present invention is to provide a charging roller that can control a current value change to a small level against expansion and contraction of a roller, and provide stable, superior, uniform charging properties and image quality.

That is, the present invention provides a charging roller comprising at least a supporting member and a conductive coating member, wherein the conductive coating member is compose of a seamless tube that contains at least (1) a non-polar resin or elastomer and (2) a polar resin or elastomer.

In the present invention, since the above-mentioned materials are contained, it becomes possible to provide a charging roller that can reduce changes in the resistance value due to expansion and contraction of the tube, and achieve stable, superior, uniform charging properties and image quality.

DESCRIPTION OF THE PREFERRED EMBODIMENTS

Figure 1:
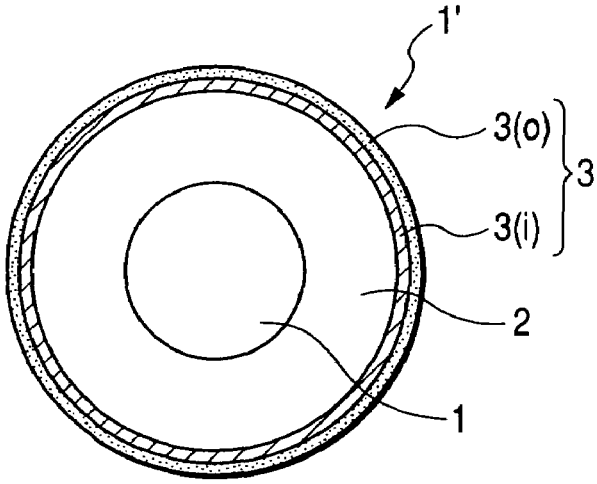
FIG. 1 is a drawing that shows a structure of a charging roller in accordance with the present invention.

The present invention is explained below in more detail.

The conductive coating member of the present invention is produced as a seamless tube which is composed of a non-polar resin or elastomer, a polar resin or elastomer and carbon black serving as a conductive agent. The mass ratio between (1) the non-polar resin or elastomer and (2) the polar resin or elastomer is set to be in a range from 95:5 to 20:80.

With respect to the non-polar resin or elastomer, examples thereof include styrene-type thermoplastic elastomers, and specifically include: poly(styrene-hydrogenated butadiene-crystal olefin) ternary block copolymers (SEBC), poly(styrene-hydrogenated butadiene-styrene) ternary block copolymers (SEBS), poly(styrene-butadiene-styrene) ternary block copolymers (SBS), poly(styrene-hydrogenated isoprene-styrene) ternary block copolymers (SEPS) and poly(styrene-vinyl isoprene-styrene) ternary block copolymers.

The polar resin includes a linkage which contains at least nitrogen or oxygen. This linkage includes at least one linkage selected from the group consisting of urethane-type, amide-type, ester-type, acryl-type and ether-type linkages. With respect to the polar resin or elastomer, examples thereof include: polyurethane, polyamide, polyester, polyvinyl alcohol, poly(ether-ester) copolymers, poly(urethane-ether) copolymers, poly(amide-ether) copolymers and poly (urethane-ester) copolymers.

The polar functional group of the styrene copolymer which has a polar functional group is a functional group which contains at least nitrogen or oxygen. The polar functional group is at least one member selected from the group consisting of a nitrile group, an amino group, an epoxy group, a vinyl group, a phenol group, a carbonyl group and a carboxyl group. With respect to the styrene copolymer having a polar functional group, examples thereof include: poly(acrylonitrile-butadiene-styrene) ternary block copolymers (ABS), poly(acrylonitrile-styrene) block copolymers (AS), poly (acrylonitrile-ethylene propylene rubber-styrene) block copolymers (AES), polycarbonate resins, phenol resins, poly(styrene-butadiene epoxy) copolymers (ESBS) and poly (styrene-ester) copolymers.

The proper content ratio of the above-mentioned two components defers depending on materials, and when the rate of the styrene-type thermoplastic elastomer becomes excessive, the effect of reducing a change in resistance against expansion is lowered. In contrast, when the rate of the styrene copolymer having a polar functional group becomes excessive, the properties as an elastomer are weakened, with the result that a problem is raised in that the tube ruptures or cracks due to inelasticity during the coating process, making it difficult to function as the charging roller.

In addition, in order to improve the compatibility of the above-mentioned materials, if necessary, a compatibility-enhancing agent may be used.

The carbon black for imparting conductivity is used in an amount of 10 to 60% by mass, more preferably 20 to 40% -by mass, with respect to the total mass of (1) the non-polar resin or elastomer and (2) the polar resin or elastomer. In the case where the rate of the carbon black is less than 10% by mass, when used as electric current passes through, the resistance rise becomes large, and hence a problem is created in that the durability as a charging roller deteriorates. In contrast, when the rate of the carbon black is more than 60% by mass, the tube becomes too hard, resulting in degradation in elastic properties to cause failure in coating.

With respect to types of carbon black, any carbon black may be used as long as the resistance value of the conductive coating member is set to be $1\times10^{6}$ to $1\times10^{11}$ Ω·cm and the above-mentioned content range is satisfied, and two or more kinds of carbon black may be mixed and used.

With respect to the carbon black in the present invention, examples of commercial products thereof include: Ketchen black (manufactured by Lion Akzo Co., Ltd.), Printex, Special Black, Color Black (manufactured by Degussa Industries, Inc.), BLACK PEARLS (manufactured by Cabot Corp.), Asahi Carbon (manufactured by Asahi Carbon Co., Ltd.), Mitsubishi carbon (manufactured by Mitsubishi Chemical Corporation), Denka black (manufactured by Denki Kagaku Kogyo K.K.), Sheast and Toka Black (which are manufactured by Tokai Carbon Co., Ltd.).

With respect to the other additives, a conductive filler, an antioxidant, a softener, a plasticizer, a reinforcer, a filler agent, etc. are used, if necessary. With respect to the conductive filler, the above-mentioned carbon black may be used as an essential component to which graphite and a metal oxide are added. With respect to the metal oxide, examples thereof include titanium oxide and lead oxide.

The manufacturing method of the seamless tube forming the conductive coat layer of the present invention may be carried out in the following procedure: First, a non-polar resin or elastomer, a polar resin or elastomer and carbon black are mixed and kneaded together with requisite additives, and subsequently formed into pellets; Next, the resulting pellets are formed into a seamless tube by using an extrusion molding machine; Then, the support member is covered with the seamless tube thus molded so that a conductive member is formed.

In coating the support member with the seamless tube, for example, the following methods may be used: the inner diameter of the seamless tube is made larger than the outer diameter of the support member to be coated so that the tube is contracted to fit thereto by using physical or chemical means, such as heat, or the inner diameter of the seamless tube is made smaller than the outer diameter of the support member to be coated so that the tube is pressed and expanded to fit thereto by using physical or chemical means, such as air pressure. In accordance with the present invention, since the seamless tube suitable for the production is obtained as described above, a conductive member having superior characteristics can be consequently prepared.

Although not particularly limited, the thickness of the seamless tube of the present invention is preferably set to be in a range from 100 to 600 μm. Moreover, a multi-layer simultaneously-molded tube may be used.

The following description will discuss the structure, material or manufacturing method of the support member to be coated, which may be employed in the present invention.

As the form thereof, an elastic roller is used. With respect to the material thereof, metal such as iron, copper and stainless steel, a carbon dispersion resin, or a metal or metal-oxide dispersion resin may be used for a conductive substrate may be used, and with respect to the shape thereof, a rod shape, a plate shape or the like may be used. With respect to the structure of the elastic roller, for example, a roller, which is formed by placing an elastic layer on the conductive substrate, with a conductive layer or a resistance layer being further formed thereon, is used, and the elastic layer may be formed by using a rubber such as chloroprene rubber, isoprene rubber, EDAM rubber, polyurethane rubber, epoxy rubber and butyl rubber, or a sponge, or a thermoplastic resin such as styrene-butadiene, polyurethane, polyester and ethylene-vinyl acetate resins. These rubbers and resins may contain a conductive agent, such as carbon black, metal and metal oxide particles.

As for the conductive layer, for example, a metal vapor deposition film, a conductive particle dispersion resin, a conductive resin, etc. may be used, and specific examples thereof include vapor deposition films made from aluminum, indium, nickel, copper or iron, and with respect to the conductive particle dispersion resin, examples thereof include dispersion resins in which conductive particles, such as carbon, aluminum, nickel or titanium oxide, are dispersed in a resin, such as urethane resin, polyester resin, a vinyl acetate-vinyl chloride copolymer and polymethyl methacrylate resin. With respect to the conductive resin, examples thereof include polymethyl methacrylate containing a quaternary ammonium salt, polyvinyl aniline, polyvinyl pyrrole, polydiacetylene and polyethylene imine.

As for the resistance layer, for example, a conductive resin and a conductive particle dispersion insulating resin may be used. As the conductive resin, resins such as ethyl cellulose, cellulose nitrate, methoxymethylated nylon, ethoxymethylated nylon, copolymerization nylon, polyvinylhydrin and casein, are used. Examples of the conductive particle dispersion resin include materials prepared by dispersing a small amount of conductive particles, such as carbon, aluminum, indium oxide and titanium oxide, in an insulating resin such as urethane resin, polyester resin, vinyl acetate-vinyl chloride copolymer and polymethyl methacrylate.

The charging roller having the support member and the seamless tube in accordance with the constitution of the present invention is superior in production stability, and is stably provided with a middle-resistance region that has been considered to be difficult to produce in a stable manner.

FIG. 1 shows an example of the structure of a charging roller 1' in accordance with the present invention. In FIG. 1, reference numeral 1 represents a conductive substrate, 2 represents an elastic body layer, 3 represents a coating layer, 3(*i*) represents a conductive layer, and 3(*o*) represents a conductive coating layer in the present invention. Here, the conductive substrate 1, the elastic body layer 2 and the conductive layer 3(*i*) are collectively referred to as a support member.

EXAMPLES

The following description will discuss, in particular, the formation of a coating layer in accordance with the present invention. In the following Examples and Comparative Examples, reference to parts is by mass.

Example 1-1

In the present Example, as materials for a conductive coating member with which a support member was coated in the form of a seamless tube, 40 parts of a styrene-type thermoplastic elastomer (Dinaron 4600P, manufactured by JSR Co., Ltd.) and 60 parts of an amide-type thermoplastic elastomer (Pebax 4033, manufactured by Atofina Japan K.K.) were used, and 40 parts of carbon black (Toka Black #4300 Tokai Carbon Co., Ltd.), 10 parts of magnesium oxide and 1 part of calcium stearate were further added thereto.

After the above-mentioned materials had been melt-kneaded at 20 to 220° C. by using a pressurization-type kneader, the resulting mixture was cooled and ground by a grinder, then granulated at 140 to 200° C. by using a single-axis extruder, to produce pellets for a conductive coating member (conductive coating layer).

For a tube inner layer of a two-color tube, 16 parts of Ketchen Black EC, 10 parts of magnesium oxide and 1 part of calcium stearate were added to 100 parts of a thermoplastic polyurethane elastomer (TPU), and the resulting mixture was kneaded for 15 minutes at 180° C. by using a pressurization-type kneader, and after having been cooled and ground, was formed into pellets by using a granulating extruder.

Using the pellets for the conductive coating layer and the pellets for the tube inner layer as mentioned above, extrusion molding was carried out by means of a two-color extruder provided with a die having an inner diameter ϕ16.5 mm and a point having an outer diameter ϕ18.5 mm, followed by sizing and cooling, thus a seamless tube having an inner diameter ϕ11.1 mm, an outer layer thickness of 100 μm and an inner layer thickness of 400 μm was formed.

Example 1-2

The same procedure as in Example 1-1 was carried out except that in place of the amide-type thermoplastic elastomer, an ester-type thermoplastic elastomer (Hitrel 3046, manufactured by DuPont-Toray Co., Ltd.) was used as the material for the conductive coating member to produce pellets. Using these pellets and the pellets for the inner layer produced in Example 1-1, a seamless tube was formed in the same manner as in Example 1-1.

Comparative Example 1-1

The same procedure as in Example 1-1 was carried out except that in place of the amide-type thermoplastic elastomer, 60 parts of an impact-resistant polystyrene (HIPS9152, manufactured by PS Japan Co., Ltd.) was used as the material for the conductive coating member and that the addition amount of carbon black was changed from 40 parts to 30 parts, producing pellets. Using these pellets and the pellets for the inner layer manufactured in Example 1-1, a seamless tube was formed in the same manner as in Example 1-1.

Example 2-1

As materials for the conductive coating member, 60 parts of a styrene-type thermoplastic elastomer (Dinaron 4600P, manufactured by JSR Co., Ltd.) and 40 parts of an acrylonitrile-styrene co-polymer resin (SAN-R Techno Polymer Co., Ltd.) were used, and 50 parts of carbon black (Special Black 550, manufactured by Degussa Huels Japan Industries, Inc.), 10 parts of magnesium oxide and 1 part of calcium stearate were further added thereto.

Except for the above, the same procedure as in Example 1-1 was carried out to produce pellets. Using these pellets and the pellets for the inner layer manufactured in Example 1-1, a seamless tube was formed in the same manner as in Example 1-1.

Example 2-2

The same procedure as in Example 2-1 was carried out except that as materials for the conductive coating member, 80 parts of a styrene-type thermoplastic elastomer (Dinaron 4600P, manufactured by JSR Co., Ltd.) and 20 parts of an acrylonitrile-styrene co-polymer resin (SAN-R Techno Polymer Co., Ltd.) were used, thus a seamless tube was formed.

Example 2-3

The same procedure as in Example 2-1 was carried out except that as materials for the conductive coating member, 90 parts of a styrene-type thermoplastic elastomer (Dinaron 4600P, manufactured by JSR Co., Ltd.) and 10 parts of an acrylonitrile-styrene co-polymer resin (SAN-R Techno Polymer Co., Ltd.) were used, thus a seamless tube was formed.

Example 2-4

The same procedure as in Example 2-3 was carried out except that in place of the acrylonitrile-styrene copolymer resin, a poly(styrene-butadiene-epoxy) copolymer (Epofriend A1020, manufactured by Daicel Chemical Industries Ltd.) was used as the material for the conductive coating member and that the addition amount of carbon black was changed from 50 parts to 40 parts, thus a seamless tube was formed.

Comparative Example 2-1

The same procedure as in Example 2-2 was carried out except that in place of the acrylonitrile-styrene copolymer resin, an impact-resistant polystyrene (HIPS9152, manufactured by PS Japan Co., Ltd.) was used as the material for the conductive coating member, thus a seamless tube was molded and formed.

A charging roller shown in FIG. 1 has a structure in which an elastic body layer (foaming elastic body layer) 2 made from a conductive elastic material is formed on the periphery of a conductive substrate (mandrel) 1 made from a good conductive material such as stainless steel (SUS), plated iron, brass and conductive plastic, and the periphery of the elastic body layer 2 is further coated with the above-mentioned two-color seamless tube. Here, in the present evaluation process, the outer diameter of the center portion of the elastic body layer was set to be 12.1 mm which was greater by 1 mm than the tube inner diameter, so that the tube was allowed to sufficiently expand. In FIG. 1, the conductive layer (inner layer) 3(*i*) represents the low-resistant conductor layer and the conductive coating layer (outer layer) 3(*o*) represents the tube in the present invention, thus constituting the tube configuration according to the present invention. This roller was installed in a process cartridge to carry out image formation.

The images formed by using the above-mentioned roller were evaluated, and the evaluation results are shown in Table 1. In the Examples of the present invention in which the polar resin was used, no problems were raised in the images, but in the Comparative Examples, black band-shaped irregularities ascribable to an increase in the resistance of the tube occurred.

Figure 2:
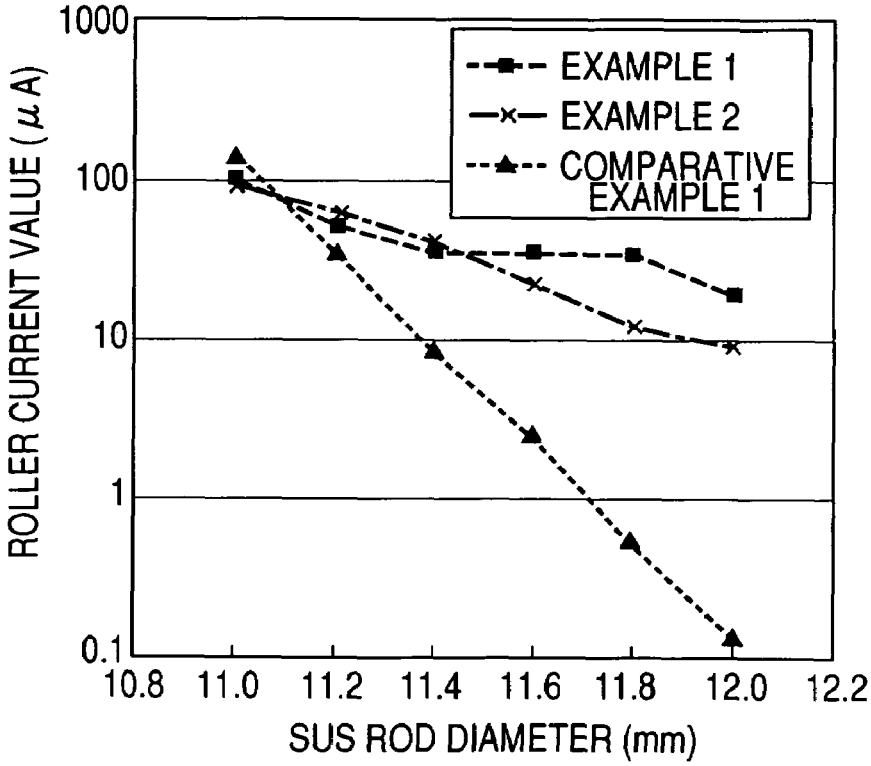
FIG. 2 is a drawing that shows a relationship between a SUS rod diameter and a roller current value.
Figure 3:
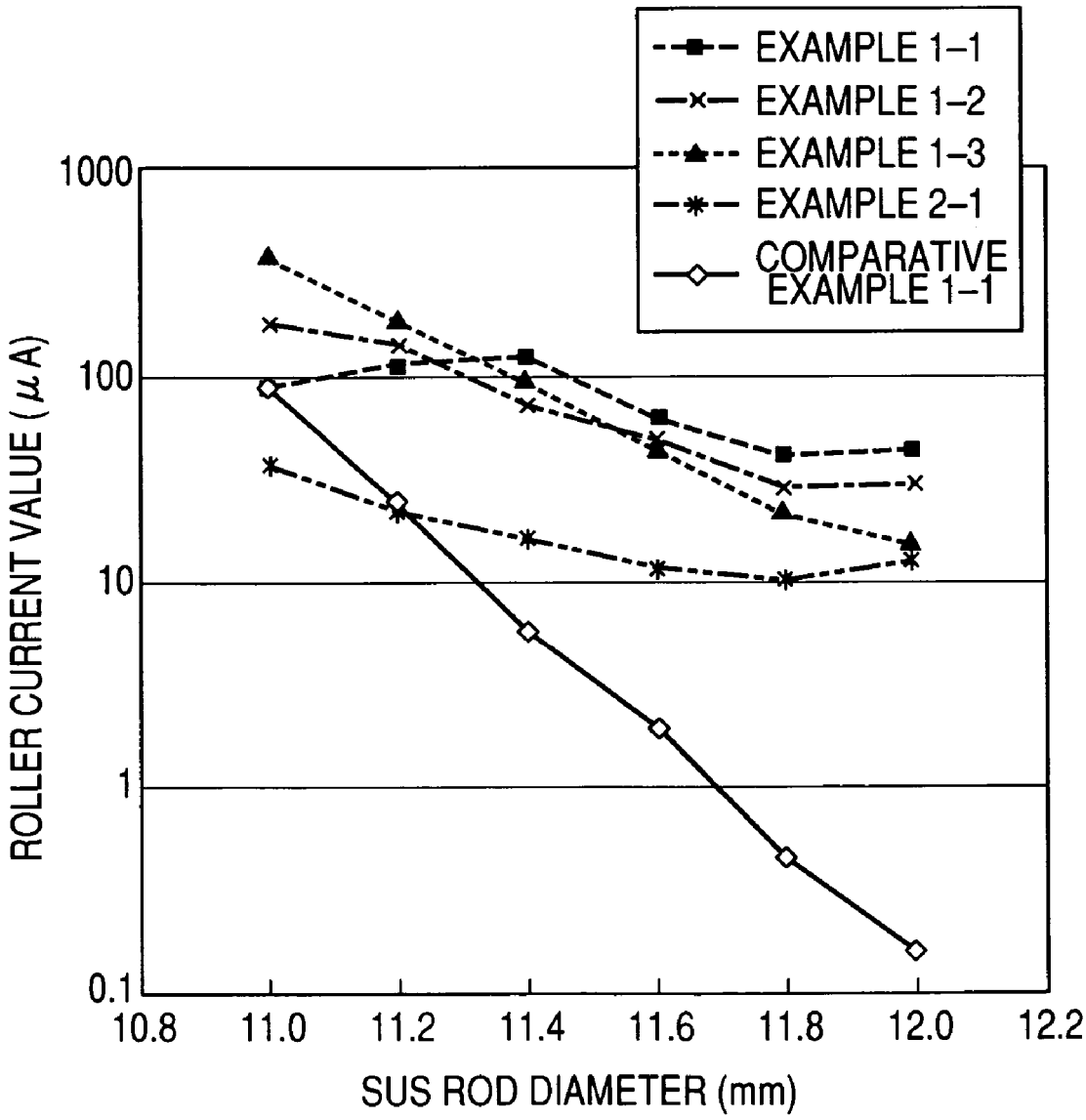
FIG. 3 is a drawing that shows a relationship between a SUS rod diameter and a roller current value.

The measuring method for a change in the resistance value in response to the expansion of the seamless tube is explained below: The above-mentioned single-layer seamless tube was attached to SUS rods (ϕ: 11.0, 11.2, 11.4, 11.6, 11.8, 12.0 mm) having respectively different diameters, and each of the rods was left standing in an environment at a temperature of 25° C. and a humidity of 55% for 24 hours. The expansion rates of the tube were respectively 0% in ϕ11.0 mm, 0.9% in ϕ11.2 mm, 2.7% in ϕ11.4 mm, 4.5% in ϕ11.6 mm, 6.3% in ϕ11.8 mm and 8.1% in ϕ12.0 mm. Thereafter, each of the SUS rods having respectively different diameters was brought into contact with a SUS drum (ϕ30 mm), and a current value was measured when a dc voltage of 200 V was applied to the SUS drum while being rotated at 30 rpm. The measurement results are shown in FIGS. 2 and 3. In addition, the ratio of a current value in the SUS rod diameter of ϕ12.0 mm to a current value in the SUS rod diameter of ϕ11.0 mm was shown in Table 2.

As indicated by FIGS. 2 and 3 as well as Table 2, in the Examples of the present invention in which polar resins were used, the change of the resistance value with respect to the expansion is maintained at a small level. On the other hand, in the Comparative Examples in which polar resins were not used, the change of the resistance value becomes extremely greater, which is considered to cause the aforementioned irregularities in the image evaluation.

TABLE 1

| | Image |
|---|---|
| Example 1-1 | A |
| Example 1-2 | A |
| Comparative Example 1-1 | B |
| Example 2-1 | A |
| Example 2-2 | A |
| Example 2-3 | A |
| Example 2-4 | A |
| Comparative Example 2-1 | B |

A: No image irregularities due to resistance irregularities of the charging roller B: Black band-shaped image irregularities due to resistance irregularities of the charging roller

TABLE 2

| | ϕ12.0/ϕ11.0 |
|---|---|
| Example 1-1 | 4.9 |
| Example 1-2 | 9.8 |
| Comparative Example 1-1 | 971.4 |
| Example 2-1 | 2.1 |
| Example 2-2 | 6.2 |
| Example 2-3 | 26.1 |
| Example 2-4 | 3.1 |
| Comparative Example 2-1 | 537.6 |

This application claims priority from Japanese Patent Application Nos. 2004-271809 filed on Sep. 17, 2004 and 2004-273524 filed on Sep. 21, 2004, which are hereby incorporated by reference herein.

What is claimed is:

1. A charging roller comprising:

a support member; and a conductive coating member, wherein the conductive coating member is composed of a seamless tube that contains at least (1) a non-polar resin or a styrene-type thermoplastic elastomer excluding a poly(styrene-hydrogenated butadiene-styrene) block terpolymer and (2) a polar resin or an elastomer having a polar functional group containing at least nitrogen or oxygen, and contains carbon black in an amount of 10% to 60% by mass with respect to the total mass of the non-polar resin or elastomer and the polar resin or elastomer.

2. The charging roller according to claim 1, wherein the seamless tube has a thickness of 100 μm to 600 μm.

* * * * *

UNITED STATES PATENT AND TRADEMARK OFFICE

CERTIFICATE OF CORRECTION

PATENT NO. : 7,283,771 B2
APPLICATION NO. : 11/224115
DATED : October 16, 2007
INVENTOR(S) : Hirobumi Takahashi et al.

It is certified that error appears in the above-identified patent and that said Letters Patent is hereby corrected as shown below:

COLUMN 1:
Line 17, “have” should read --has--;
Line 24, “is” should read --are--;
Line 61, “or” should read --and--; and
Line 63, “with the result” should read --the result is--.

COLUMN 2:
Line 47, “changes” should read --changes arise--;
Line 50, “changes” should read --changes arise--; and
Line 65, “compose” should read --composed--.

COLUMN 3:
Line 61, “defers” should read --differs--.

COLUMN 4:
Line 8, “-by” should read --by--.

COLUMN 5:
Line 8, “substrate may be used,” should read --substrate--.

Signed and Sealed this

Twenty-seventh Day of May, 2008

JON W. DUDAS
*Director of the United States Patent and Trademark Office*